US005685241A

United States Patent [19]

Ito et al.

[11] Patent Number: 5,685,241

[45] Date of Patent: Nov. 11, 1997

[54] LINED LATERAL ROTARY KILN INCINERATOR

[75] Inventors: Katsuhiro Ito; Takeshi Ito, both of Tokyo, Japan

[73] Assignee: Kabushiki Kaisha Daiken Enterprise, Tokyo, Japan

[21] Appl. No.: 710,094

[22] Filed: Sep. 11, 1996

[51] Int. Cl.[6] ..... F23G 5/02

[52] U.S. Cl. ..... 110/246; 110/247; 110/346; 432/105; 432/106

[58] Field of Search ..... 110/235, 246, 110/346, 247, 226; 432/105, 106, 107

[56] References Cited

U.S. PATENT DOCUMENTS 4,890,563 1/1990 White et al. ..... 110/246
5,220,874 6/1993 Keating, III et al. ..... 110/246

FOREIGN PATENT DOCUMENTS h0614730 2/1994 Japan ..... 110/246

*Primary Examiner*—Henry A. Bennett
*Assistant Examiner*—Pamela A. O'Connor
*Attorney, Agent, or Firm*—Notaro & Michalos P.C.

[57] ABSTRACT

A furnace body (4) consists of drums (D1, D2, and D3) which are supported and drove by rotation drive assemblies (3) independently of each other. Each drum has open ends at both sides, and adjacent open ends are engaged to each other in a rotatable manner. One open end of the furnace body (4) are provided with a waste feeding assembly (6), and the other is provided with a gas exhausting assembly (7). Oxygen supply units (5) are connected to the joint between the open ends of adjacent drums.

6 Claims, 4 Drawing Sheets

LINED LATERAL ROTARY KILN INCINERATOR

BACKGROUND OF THE INVENTION

The present invention relates to a lined lateral rotary kiln incinerator capable of incinerating effectively a large volume of wastes including low-calorie wastes or high-moistured wastes containing much water, such as juice, sludge, foul solution, waste liquor, effluent, biosolids, and wet refuse and high-calorie wastes such as paper, wood, and lawn.

The term "incineration" refers to a process of burning a waste in which an organic material therein is oxidized, evolving heat, light, or energy.

Wastes may be burned in an pyrolysis furnace into which control air is introduced through the bottom thereof. The wastes are partially burned at the bottom of the pyrolysis furnace to produce heat, which increases the temperature of portions of the wastes not burned yet. Organic materials are decomposed and volatilized successively. All wastes at the bottom of the furnace are thus burned into a hearth (red heat layer) and the upper portions thereof are then decomposed and volatilized (fluidized layer). A more upper portion is absorbed (heat transfer layer) and the uppermost portion is decomposed into gas (gas layer). In this way, the wastes in the pyrolysis furnace are burned gradually from the bottom to the top.

This process is referred to as "retort", which is completed when the thermal decomposition of the organic material finishes. Subsequently, carbonization begins and decomposition gas from the pyrolysis furnace is heated due to auxiliary burning in a gas combustion furnace. Necessary air is then supplied to the gas combustion furnace to complete the wastes.

Accordingly, the organic materials in the high-moistured wastes are burned successively from the bottom to the top in the conventional pyrolysis furnace. Such a pyrolysis furnace is not suitable for the wastes including low-calorie wastes or high-moistured wastes containing much water, such as juice, sludge, foul solution, waste liquor, effluent, biosolids, and wet refuse and high-calorie wastes such as paper, wood, and lawn.

With this respect, a hydroextractor is installed in the upstream of a line to feed the high-moistured wastes to the pyrolysis furnace. The hydroextractor serves to reduce the water content of the wastes, as much as possible. For this purpose, the conventional incinerator facilities for the low-calorie wastes are require to have a hydroextractor in addition to the incinerator itself. Alternatively, a combustion promoting agent is mixed with the wastes to improve the combustion efficiency. This combustion promoting agent becomes an additional cost for incineration. In addition, the temperature of a gas burner is set to an unnecessarily high level, which badly affects on the fuel consumption. On the contrary, incineration of such wastes that contains high-calorie wastes requires no pre-treatment as in the incineration of the low-calorie wastes. The gas burner is not required to be set at a high temperature. Accordingly, it is necessary to separate the high-calorie wastes from the low-calorie wastes and incineration facilities thus require at least two incinerators for treating these wastes. Such facilities are not cost-effective and have many other disadvantages.

Conventional vertical incinerators receive wastes, including the high-calorie wastes, through an upper portion thereof. The wastes fall down through the incinerator and are burned by using a gas burner located at the bottom of the incinerator. It is thus difficult to control an amount of wastes supplied and a combustion temperature. This means that such incinerators are not expected to provide complete combustion. Furthermore, there often remains a relatively large volume of ash or residue to be treated. This complicates post treatment of the residue remained in the furnace.

With this respect, a lateral rotary furnace as illustrated in FIG. 1 was developed, which is disclosed for example in Japanese Published Unexamined Utility Model Application no. H06-14730. Referring to FIG. 1, an elongate rotary furnace 20 comprises a base 21 on which a rotation drive assembly 22 is mounted. A furnace body 23 of a single drum is provided above the rotation drive assembly 22 in a rotatable manner. The rotation drive assembly 22 comprises a motor **22*a* and an output gear 22*b*. The furnace body 23 is provided with a drum gear 23*a* on the outer surface thereof. The output gear 22*b* is engaged with the drum gear 23*a* to rotate the furnace body 23. The furnace body 23 is also provided with flanges 23*b*, 23*b* on the outer surface at right and left sides thereof. Rotary free rollers 22*c*, 22*c* are mounted on the base 21 at right and left sides at positions corresponding to the flanges 23*b*, 23*b*, respectively. The rotary free rollers 22*c*, 22*c* receive the flanges 23*b*, 23*b*, respectively to allow smooth rotation of the furnace body 23**.

As apparent from FIG. 1, the furnace body 23 of the single drum has a tapered hollow structure. It comprises a bottom **23*c* (located at a rear side) in which an opening 23*d* is formed. The one end of the furnace body 23 opposed to the bottom 23*c* is an open end 23*e*. The bottom 23*c* is smaller in diameter than the open end 23*e*. A closure 28 is provided on the base 21 at the side of the open end 23*e*. The closure 28 comprises a gas burner 24, a gas exhausting unit (including a dust collector) 25, a residue pick-up port 26, and an air feeding unit 27. The gas burner has a fire tip facing inside the furnace body 23. The residue pick-up port is opened and closed downward. A waste feeding assembly 29 is provided on the base 21 at the side of the bottom 23*c*. The waste feeding assembly 29 comprises a screw 29*a* incorporated therein and a waste feeding end facing the furnace body 23 through the opening 23*d*. The waste feeding assembly 29 is connected to a hopper 30. The hopper is for use in storing the wastes. The wastes are thus fed to the furnace body 23 at a constant amount for incineration. The combustion efficiency of this rotary kiln incinerator is the higher than those of the above mentioned conventional pyrolysis furnace and the vertical incinerator. In addition, the rotary kiln incinerator requires no dewatering process before feeding the wastes to the furnace, which is necessary in the conventional pyrolysis furnace. Furthermore, it is not necessary for the rotary kiln incinerator to use a combustion promoting agent or to set the temperature of the gas burner 24** at a high level. In addition, the amount of the wastes to be fed and the combustion temperature can be controlled and adjusted readily because the rotary kiln incinerator does not throw the wastes into the furnace through the upper portion thereof. In addition, less residue remains in the furnace when the rotary kiln incinerator of the type described is used.

However, there still remains some problems as described below. As mentioned above, the furnace body of the rotary kiln incinerator is a single drum. Accordingly, the temperature of the furnace body should be high when the furnace body is used for the incineration of the low-calorie wastes. In addition, the furnace body is required to be rotated at a relatively low speed to dry the content. On the contrary, the temperature of the furnace body should be low when the high-calorie wastes are treated. The furnace body is required to be rotated at a relatively high speed in order to prevent a possible significant reduction of the combustion efficiency. If the wastes to be treated contain both the low-calorie wastes and the high-calorie wastes, the rotation speed is relatively low to burn the low-calorie wastes completely. However, the high-calorie wastes are not burned well when the furnace body is rotated at a low speed. Therefore, it is necessary to determine optimum rotation speed and temperature depending on the wastes to be treated. Such control is, however, rather difficult and no ideal combustion can be achieved.

Accordingly, the present invention is directed to overcome the above mentioned problems and an object thereof is to provide a lateral rotary kiln incinerator capable of incinerating effectively a large volume of wastes including low-calorie wastes of high-moistured wastes containing much water, such as juice, sludge, foul solution, waste liquor, effluent, biosolids, and wet refuse and high-calorie wastes such as paper, wood, and lawn.

SUMMARY OF THE INVENTION

According to an aspect of the present invention, there is provided a lined lateral rotary kiln incinerator comprising: a furnace body having a plurality of drums laterally arranged and supported such that the drums are rotatable independently of each other, each of the drums having openings at both ends thereof; rotation drive means provided for each of the drums for rotating the each of the drums; waste feeding means connected to one end of said furnace body; and burning means for burning the waste in said furnace body.

DESCRIPTION OF THE PREFERRED EMBODIMENT.

Figure 1:
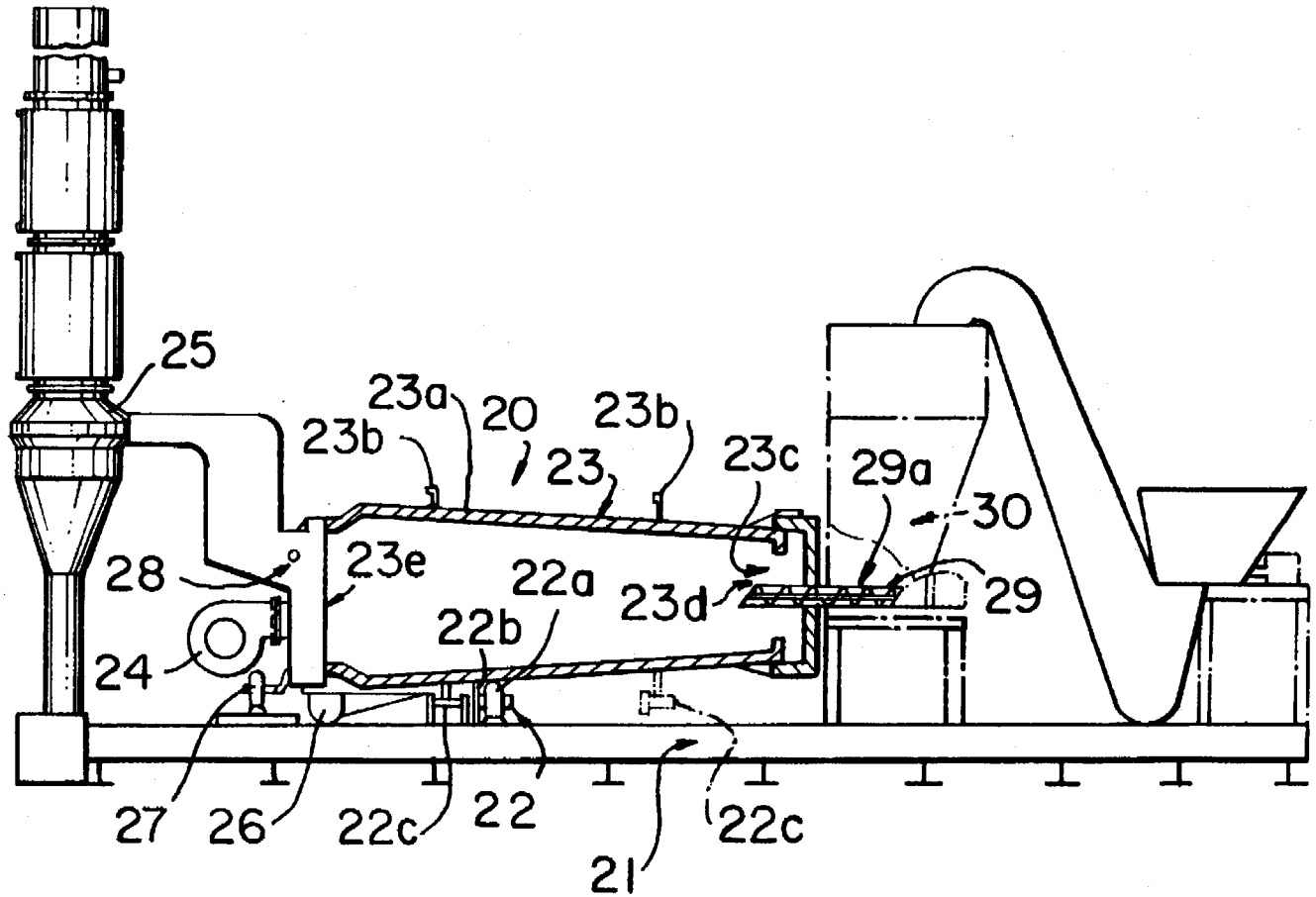
FIG. 1 PRIOR ART
FIG. 1 is a schematic view for use in describing a conventional rotary kiln incinerator.
Figure 2:
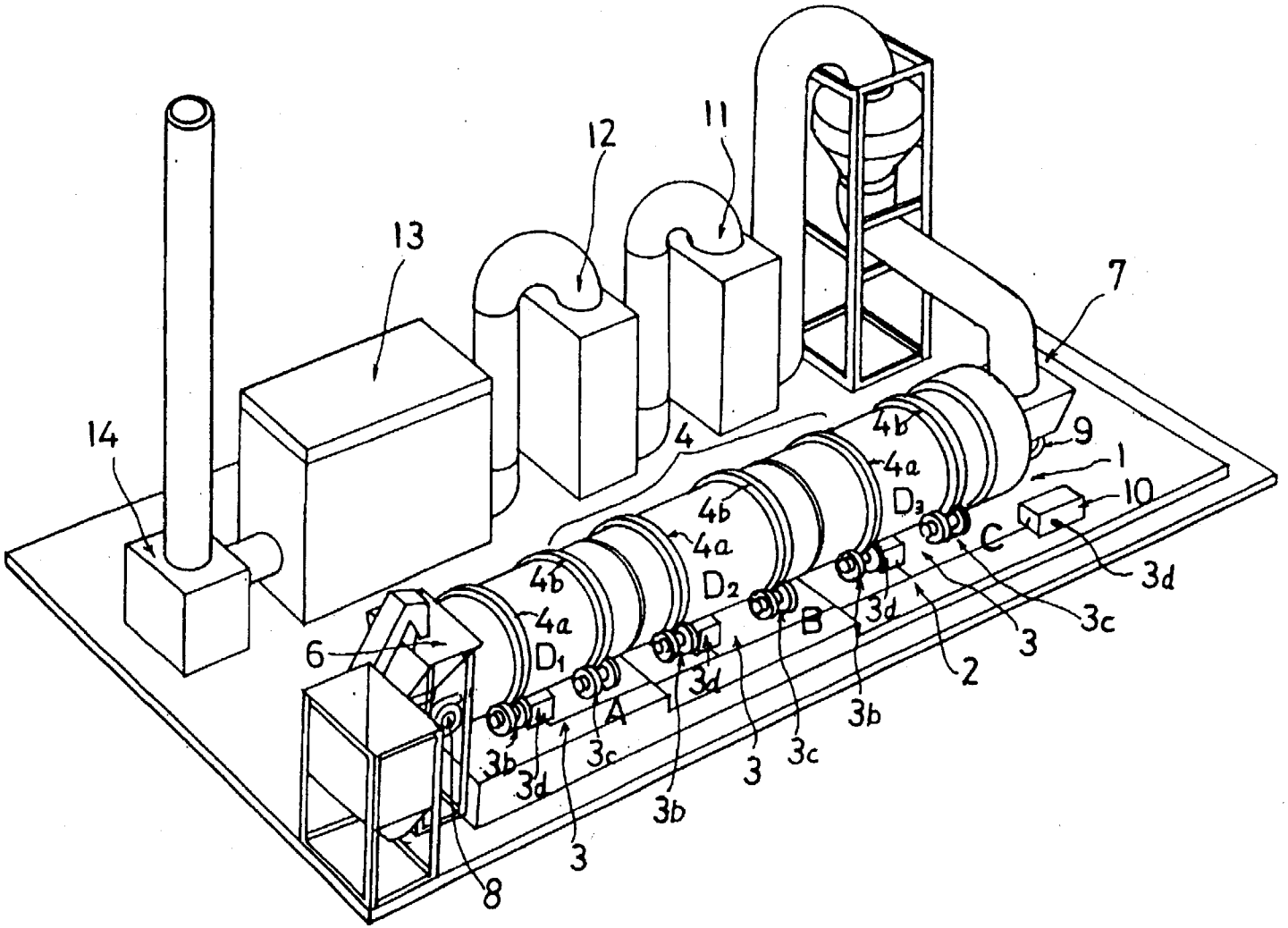
FIG. 2 is a perspective view of a lined lateral rotary kiln incinerator according to an embodiment of the present invention.
Figure 3:
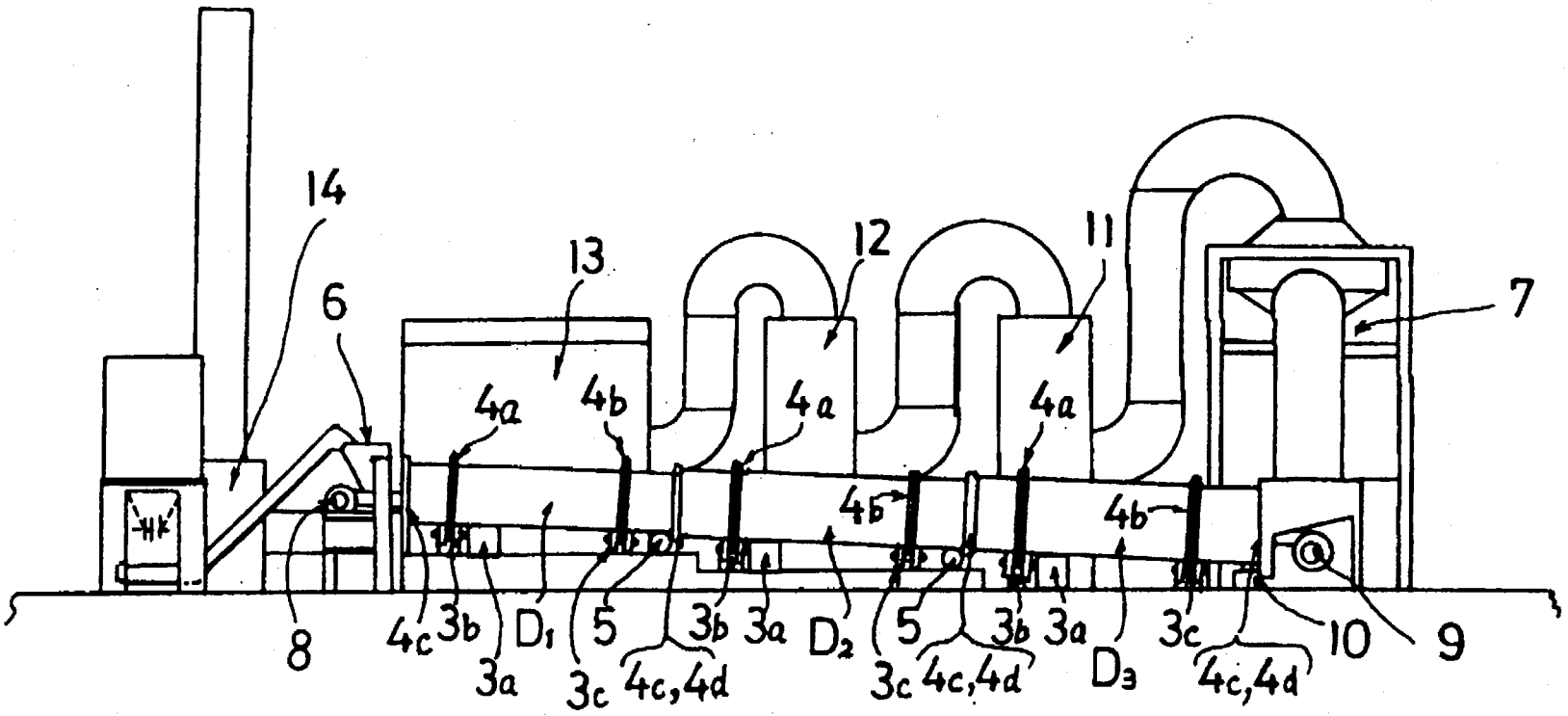
FIG. 3 is a side view of the lined lateral rotary kiln incinerator shown in FIG. 2.
Figure 4:
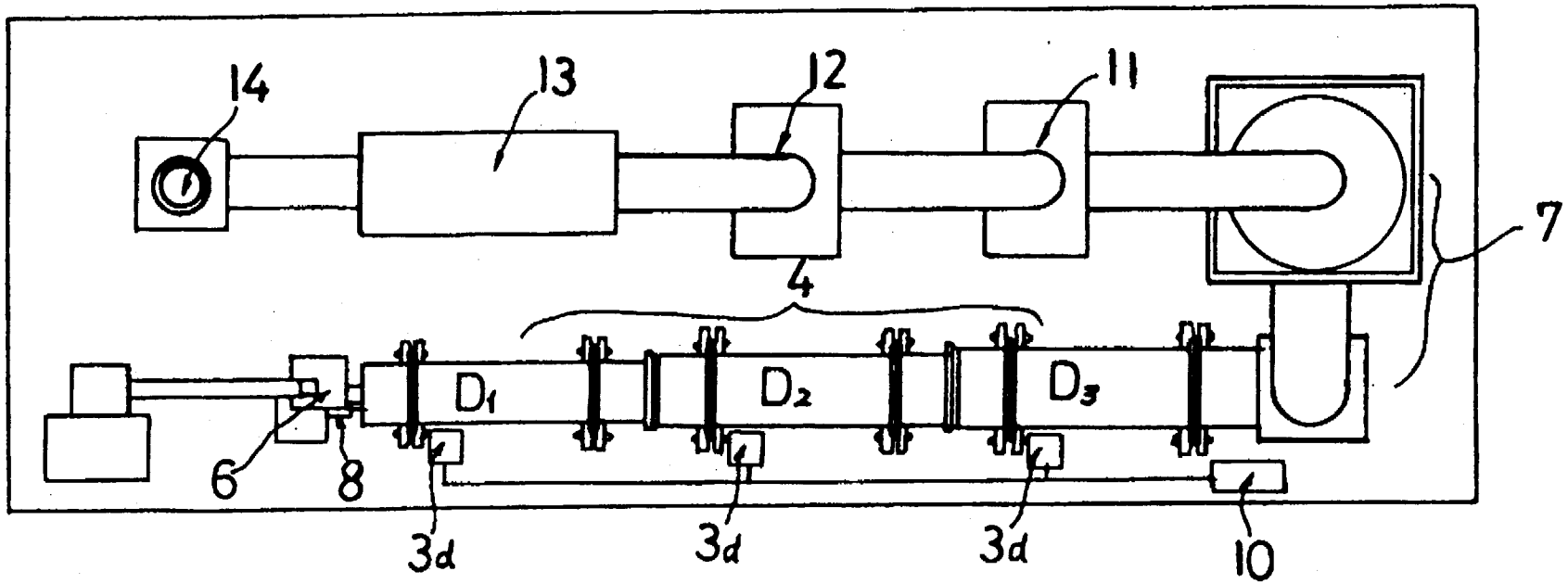
FIG. 4 is a top plan view of the lined lateral rotary kiln incinerator shown in FIG. 2.

An embodiment of the present invention is now described with reference to FIGS. 2 through 4.

A lined lateral rotary kiln incinerator 1 comprises a base 2 on which rotation drive assemblies 3 are mounted. The rotation drive assemblies 3 in this embodiment are provided for three blocks A, B, and C, respectively. A furnace body 4 is mounted above the rotation drive assembly 3 in a rotatable manner. The furnace body 4 in this embodiment is formed of three drums D1, D2, and D3. Each rotation drive assembly 3 comprises a motor 3*a* and an output gear 3*b*. The furnace body 4 is provided with a drum gear 4*a* on the outer surface thereof. The output gear 3*b* is engaged with the drum gear 4*a* to rotate the furnace body 4. The furnace body 4 is also provided with flanges 4*b* on the outer surface at right and left sides thereof. Rotary free rollers 3*c* are mounted on the base 2 at right and left sides at positions corresponding to the flanges 4*b*. The rotary free rollers 3*c* receive the corresponding flanges 4*b* to allow smooth rotation of the furnace body 4. A rotation controller 3*d* is placed on the base 2 to provide variable control of the rotation speed of the drums D1, D2, and D3 forming the furnace body 4.

Each drum has open ends 4*c* and 4*d*. The drums D1, D2, and D3 of the furnace body are different in diameter. More specifically, the drum D1 in this embodiment is 2 m 80 cm in diameter and 12 m in length, the drum D2 2 m 48.2 cm and 12 m, and the drum D3 1 m 91.8 cm and 12 m. The drums D1, D2, and D3 are aligned at a predetermined inclination angle determined by considering conveyance of wastes during rotation of the furnace body. The adjacent open ends 4*c* and 4*d* are engaged with and coupled to each other in a rotatable manner to form the furnace body 4.

Oxygen supply units 5 are connected to the joint between the open ends 4*c* and 4*d* of the adjacent drums. Each oxygen supply unit is formed of, for example, a compressor to supply a predetermined amount of oxygen into the furnace body 4.

One open end of the drum D1 is provided with a waste feeding assembly 6 to feed wastes including low-calorie wastes of high-moistured wastes containing much water, such as juice, sludge, foul solution, waste liquor, effluent, biosolids, and wet refuse and high-calorie wastes such as paper, wood, and lawn. One open end of the drum D3 is provided with a gas exhausting assembly 7 including a cyclone-type dust collector. The drums D1 and D3 are equipped with a first burner 8 and a second burner 9, respectively. A residue discharging assembly 10 is mounted on the base near the lower end of the drum D3. This residue discharging assembly 10 is for transferring residues at a high efficiency out of the furnace body 4 even when the residues contain powder and solid blocks. A frame temperature of the burners 8 and 9 is controlled by using a proportional controller (not shown) to achieve effective burning of the wastes fed to the furnace body 4.

The lined lateral rotary kiln incinerator 1 also comprises a cooling tank 11, a scrubber 12, a bag filter 13, and a gas exhausting duct 14. The cooling tank 11 is connected to the gas exhausting assembly. The scrubber 12 is provided on the base 2 downstream of the cooling tank 11. Likewise, the bag filter 13 is provided on the base 2 downstream of the scrubber 12. The gas exhausting duct 14 is provided on the base 2 downstream of the bag filter 13.

It is understood that the present invention is not limited to the one described above where the furnace body 4 is inclined with respect to the base 2 and is mounted rotatably by means of the rotation drive assemblies 3. The furnace body 4 may be kept horizontally when an adequate member for transferring the wastes is used. For example, one or more projections of a predetermined height may be formed on the inner surface of the drums D1, D2, and D3 to pass the wastes passed therethrough from one side to the other.

Now, description is made in conjunction with how to burn wastes effectively by using the lined lateral rotary kiln incinerator according to the present invention. As mentioned above, it is necessary to rotate the furnace body at a low speed to burn the low-calorie wastes having a high water content in order to evaporate the moisture. The drum D2 is rotated at a higher speed than the drum D1, and the drum D3 at a higher speed than the drum D2. More specifically, the drum D1 is rotated at a low speed to evaporate water and dry the wastes by using the burner 8 because the wastes in the drum D1 contain a large volume of water. The dried wastes are then transferred to the drum D2 where burning is easier than in the drum D1. Accordingly, the drum D2 is rotated at a higher speed than the drum D1 to achieve predetermined burning. The combustion efficiency is reduced if the amount of the oxygen in the furnace body is not enough. In such an event, the oxygen supply units 5 are used to supply a predetermined amount of oxygen through the joint between the open ends 4*d* and 4*c* of the drums D1 and D2, respectively, and/or the joint between the open ends 4*d* and 4*c* of the drums D2 and D3, respectively. The combustion efficiency is thus maintained at a certain level for the subsequent combustion. The waste remained without being burned in the second drum D2 is transferred to the drum D3 where it is burned completely by using the second burner 9. The rotation speed of the final drum D3 is higher than that of the second drum because the drum D3 is used for burning only those remained without being burned in the second drum.

As mentioned above, the lined lateral rotary kiln incinerator of the present invention comprises the furnace body formed of a plurality of drums coupled to each other. This increases the capacity of the furnace body as compared with the conventional rotary kiln incinerator. In addition, the amount of the wastes to be treated can be increased remarkably by the controlled rotation of the furnace body. The combustion The combustion efficiency is thus improved as well.

Furthermore, the drums are rotated at a lower speed than those described above when the wastes to be treated include low-calorie wastes of high-moistured wastes containing much water, such as juice, sludge, foul solution, waste liquor, effluent, biosolids, and wet refuse and high-calorie wastes such as paper, wood, and lawn. More specifically, it is easy to burn the wastes by using the first burner 8 because the high-calorie wastes are also supplied to the first drum D1. Accordingly, complete burning can be achieved with the drums rotated at a higher speed than those described above in conjunction with the case of burning the low-calorie wastes alone.

While the present invention has a lot of advantages over the conventional rotary kiln incinerator to burn the low-calorie wastes, it has great advantages over the conventional one to burn the high-calorie and low-calorie wastes, that is, an incineration capacity per hour is increased because of the furnace body having a larger volume than the conventional one rotated at a controlled rotation speed.

What is claimed is:

1. A lined lateral rotary kiln incinerator comprising:

a furnace body having a plurality of drums laterally arranged and supported such that the drums are rotatable independently of each other, each of the drums having openings at both ends thereof;

rotation drive means provided for each of the drums for rotating the each of the drums;

waste feeding means connected to one end of said furnace body; and burning means for burning the waste in said furnace body.

2. A lined lateral rotary kiln incinerator as claimed in claim 1 further comprising oxygen supply means provided at joint portions between adjacent drums of said furnace body.

3. A lined lateral rotary kiln incinerator as claimed in claim 1, wherein said burning means is provided at either end of said furnace body.

4. A lined lateral rotary kiln incinerator as claimed in claim 1, wherein rotation achieved by the rotation drive means provided for each drum is controlled in a variable manner by means of rotation control means associated with the rotation drive means.

5. A lined lateral rotary kiln incinerator comprising:

a furnace body having a plurality of drums laterally arranged and supported such that the drums are rotatable independently of each other, each of the drums having openings at both ends thereof;

rotation drive means provided for each of the drums for rotating each of the drums;

waste feeding means connected to one end of said furnace body; and a gas exhausting assembly connected to another end of said furnace body;

burning means for burning waste in said furnace body;

oxygen supply means provided at joint portions between said laterally arranged drums of said furnace body; and residue discharging means provided on said furnace body on a side of said gas exhausting assembly.

6. A lined lateral rotary kiln incinerator as claimed in claim 5, wherein said furnace body is inclined with one end connected to said waste feeding means being higher than another end connected to said gas exhaustion assembly.

* * * * *